US005657504A

United States Patent [19]

Khoury

[11] Patent Number: 5,657,504

[45] Date of Patent: Aug. 19, 1997

[54] ROLLER MOP WITH WET ROLLER, SQUEEGEE, AND DEBRIS PICKUP

[76] Inventor: Fouad M. Khoury, 8403 Plum Lake Dr., Houston, Tex. 77095

[21] Appl. No.: 720,765

[22] Filed: Oct. 3, 1996

[51] Int. Cl.[6] ..... A47L 11/03; A47L 11/282; A47L 11/292

[52] U.S. Cl. ..... 15/98; 15/103.5

[58] Field of Search ..... 15/98, 103.5

[56] References Cited

U.S. PATENT DOCUMENTS

| | | | |
|---|---|---|---|
| 2,642,601 | 6/1953 | Saffioti | 15/98 |
| 4,956,891 | 9/1990 | Wulff | 15/320 |
| 5,080,517 | 1/1992 | Lynn | 401/13 |

*Primary Examiner*—Mark Spisich
*Attorney, Agent, or Firm*—Kenneth A. Roddy

[57] ABSTRACT

A cleaning mop has a cylindrical roller formed of adjacent disk-shaped rings of resilient foam material which engages and rotates relative to a floor surface to be cleaned to scrub the surface when the mop is pushed in a forward direction and picks up particles of debris when the mop is moved in either direction. When the mop is pushed in a forward direction; the roller is engaged by a drive mechanism to rotate; a valve opens and cleaning liquid flows onto the roller from an onboard reservoir and a gap is formed between the rings by separator fingers as they approach the floor surface; the roller rings engage and move relative to the floor surface and the gap closes to capture particles of debris between the rings; and the dirty liquid and particles carried around the circumferential path on the roller are removed by a squeegee plate and collected in an onboard collection tank. When the mop is pulled in the rearward direction, the roller is disengaged from the drive mechanism to rotate freely and the valve closes to shut off the supply of cleaning liquid. As the disengaged roller rolls on the floor surface the separator fingers widen the gap between the rings and as they approach and engage the floor surface the gap closes to capture particles of debris between the rings; and the particles carried around the circumferential path on the roller are removed by the squeegee plate and collected in the onboard collection tank.

11 Claims, 2 Drawing Sheets

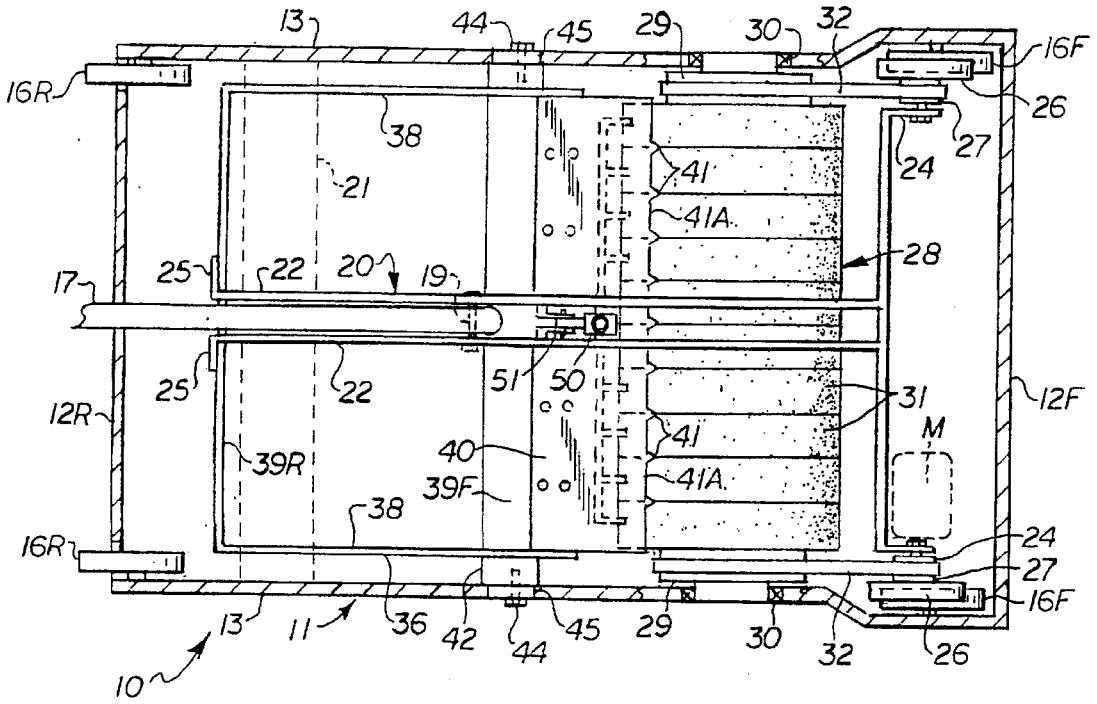
FIG. 2
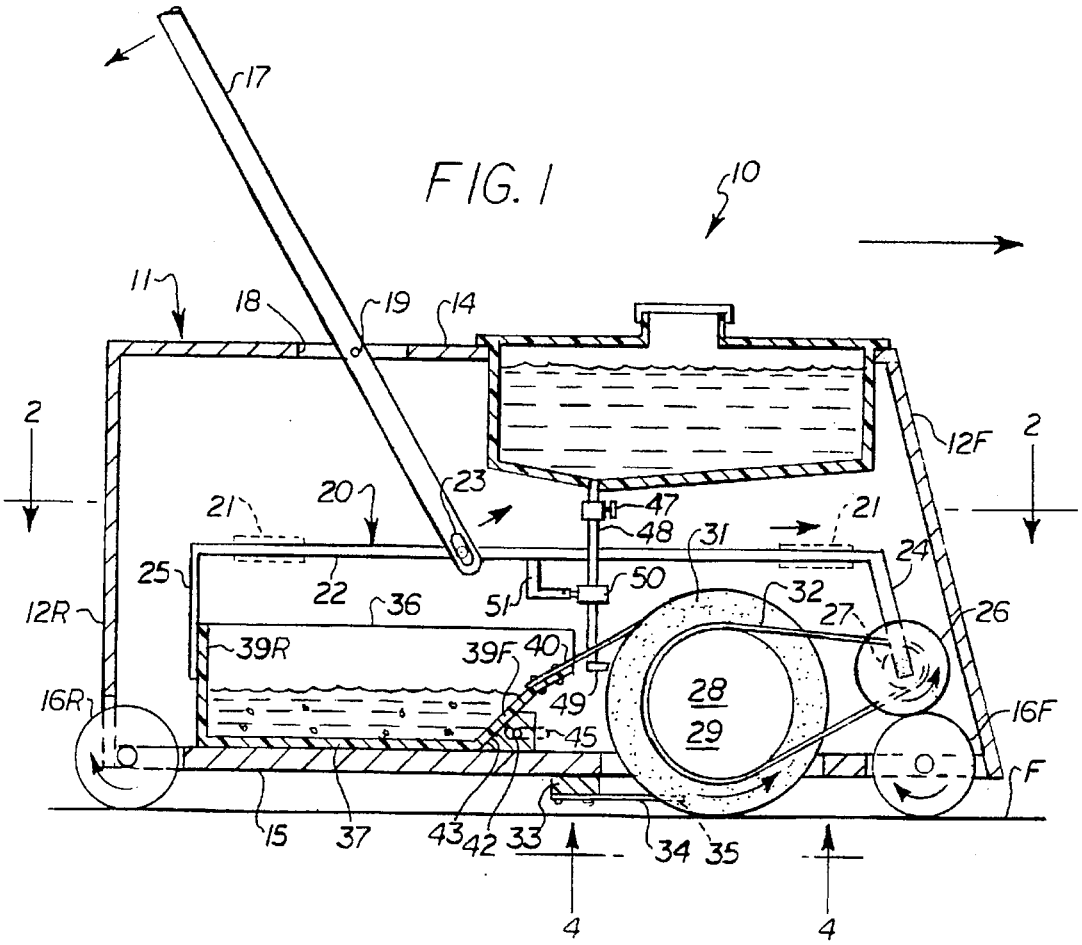

ROLLER MOP WITH WET ROLLER, SQUEEGEE, AND DEBRIS PICKUP

BACKGROUND OF THE INVENTION

1. Field of the Invention

This invention relates generally to cleaning mops, and more particularly to a cleaning mop having a cleaning liquid dispenser which wets the roller, a rotary driven roller which picks up particles of debris, and a squeegee which cleans dirty liquid and debris from the roller and directs it into a collection tank on the mop.

2. Brief Description of the Prior Art

Conventional floor mops and sponge mops are known wherein the cleaning head or sponge is wet with a cleaning liquid and the mop is pushed over the floor surface. Some of these devices are provided with a lever type wringer which squeezes excess liquid from mop head or sponge. To clean a dirty floor with the conventional mops, it requires wetting the cleaning mop head or sponge by submerging it in the cleaning liquid, wringing it out, scrubbing the floor, wringing out the dirty water, wetting the mop head or sponge with rinse water, wringing out excess rinse water, wiping the floor with the rinse water, and wringing out the dirty rinse water.

Although these devices may clean a floor, the operation consumes a great deal of time and effort. Also, some particles of debris may be captured on the mop head or sponge, most conventional floor mops and sponge mops merely push small particles around on the floor surface, rather than actually picking it up off the floor surface.

Wulff, U.S. Pat. No. 4,956,891 discloses a floor cleaning machine supported on wheels having a scrub brush, a dirty water pickup nozzle, a clean rinse water outlet, and a dirty rinse water pickup nozzle. A pair of concentric chambers retain the clean and dirty water. As clean water empties from one chamber, the dirt water fills the other, such that the center of gravity stays substantially the same.

Lynn, U.S. Pat. No. 5,080,517 discloses a mop for removing waste liquid from a floor to be cleaned which has a handle, a container for receiving liquid from the surface being cleaned which is pivotally connected to the handle, a first and second cleaning pad and a roller-type wringer. The container pivots to either of the pads for receiving liquid wrung out of the pad by the wringer.

The present invention is distinguished over the prior art in general, and these patents in particular by a cleaning mop having a cylindrical roller formed of adjacent disk-shaped rings of resilient foam material which engages and rotates relative to a floor surface to be cleaned to scrub the surface when the mop is pushed in a forward direction and picks up particles of debris when the mop is moved in either direction. When the mop is pushed in a forward direction; the roller is engaged by a drive mechanism to rotate; a valve opens and cleaning liquid flows onto the roller from an onboard reservoir and a gap is formed between the rings by separator fingers as they approach the floor surface; the roller rings engage and move relative to the floor surface and the gap closes to capture particles of debris between the rings; and the dirty liquid and particles carried around the circumferential path on the roller are removed by a squeegee plate and collected in an onboard collection tank. When the mop is pulled in the rearward direction, the roller is disengaged from the drive mechanism to rotate freely and the valve closes to shut off the supply of cleaning liquid. As the disengaged roller rolls on the floor surface the separator fingers widen the gap between adjacent rings and as they approach and engage the floor surface the gap closes to capture particles of debris between the rings; and the particles carried around the circumferential path on the roller are removed by the squeegee plate and collected in the onboard collection tank.

SUMMARY OF THE INVENTION

It is therefore an object of the present invention to provide a cleaning mop apparatus having a rotating cylindrical roller which engages and rotates relative to a surface to be cleaned to scrub the surface when the mop is pushed in a forward direction and rolls on the surface when pulled in a rearward direction, and picks up particles of debris when the mop is moved in either direction.

It is another object of this invention to provide a cleaning mop apparatus containing a supply of cleaning liquid that automatically wets a rotating cylindrical roller which engages and scrubs a surface to be cleaned when the mop is pushed in a forward direction and shuts off flow to the roller when pulled in a rearward direction.

Another object of this invention is to provide a cleaning mop apparatus which when pushed in a forward direction automatically wets a rotating cylindrical roller with cleaning liquid and engages a squeegee to squeeze dirty liquid and particles of debris from the roller after the roller has engaged and scrubbed a surface being cleaned.

Another object of this invention is to provide a cleaning mop apparatus which when pushed in a forward direction automatically wets a rotating cylindrical roller with cleaning liquid, engages a squeegee to squeeze dirty liquid and particles of debris from the roller after the roller has engaged and scrubbed a surface being cleaned, and collects the dirty liquid and particles of debris in a collection tank on the mop.

A further object of this invention is to provide a cleaning mop apparatus which lightweight and easily to maneuver.

A still further object of this invention is to provide a cleaning mop apparatus which is simple in construction, economical to manufacture and is reliable in operation.

Other objects of the invention will become apparent from time to time throughout the specification and claims as hereinafter related.

The above noted objects and other objects of the invention are accomplished by a cleaning mop having a cylindrical roller formed of adjacent disk-shaped rings of resilient foam material which engages and rotates relative to a floor surface to be cleaned to scrub the surface when the mop is pushed in a forward direction and picks up particles of debris when the mop is moved in either direction. When the mop is pushed in a forward direction; the roller is engaged by a drive mechanism to rotate; a valve opens and cleaning liquid flows onto the roller from an onboard reservoir and a gap is formed between the rings by separator fingers as they approach the floor surface; the roller rings engage and move relative to the floor surface and the gap closes to capture particles of debris between the rings; and the dirty liquid and particles carried around the circumferential path on the roller are removed by a squeegee plate and collected in an onboard collection tank. When the mop is pulled in the rearward direction, the roller is disengaged from the drive mechanism to rotate freely and the valve closes to shut off the supply of cleaning liquid. As the disengaged roller rolls on the floor surface the separator fingers widen a gap between adjacent rings and as they approach and engage the floor surface the gap closes to capture particles of debris between the rings; and the particles carried around the circumferential path on the roller are removed by the squeegee plate and collected in the onboard collection tank.

BRIEF DESCRIPTION OF THE DRAWINGS

FIG. 1 is a side elevation view of a preferred roller mop apparatus in accordance with the present invention shown in cross section with the housing being pushed in a forward direction.

FIG. 2 is a top plan view of the roller mop apparatus taken along line 2—2 of FIG. 1.

DESCRIPTION OF THE PREFERRED EMBODIMENT

Figure 7:
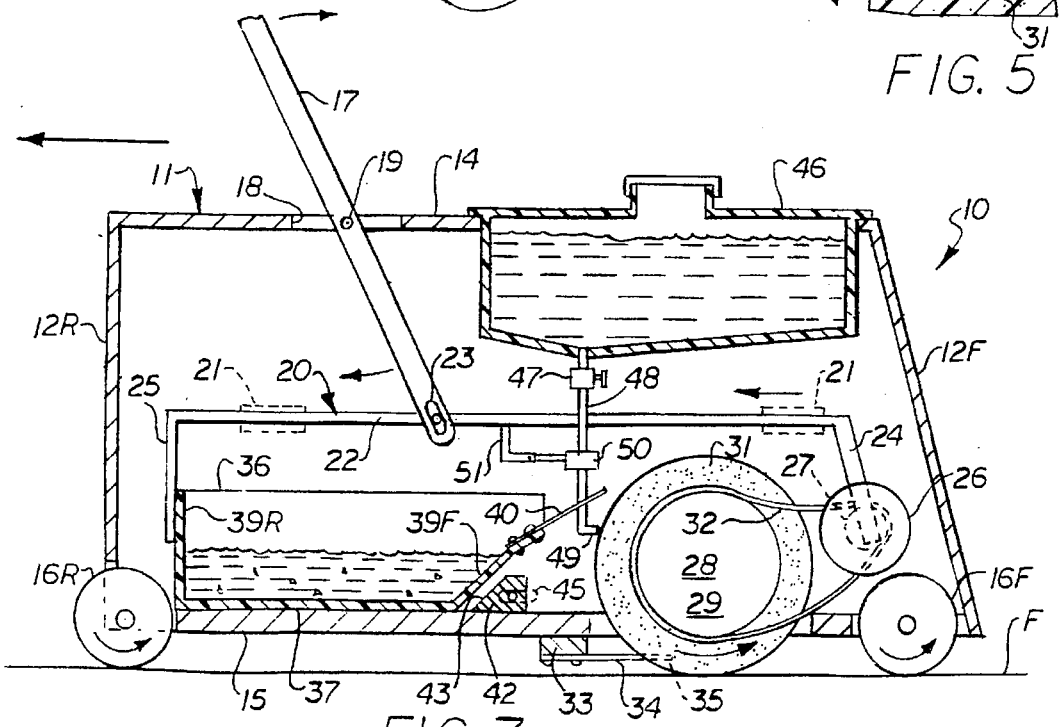
FIG. 7 is a side elevation view of the roller mop shown in cross section with the housing being pulled in a rearward direction.

Referring to the drawings by numerals of reference, there is shown in FIGS. 1, 2, and 7, an exploded perspective view of a preferred roller mop 10 in accordance with the present invention. The roller mop 10 has a support structure defining a housing 11 having front and rear walls 12F and 12R, opposed side walls 13, a top wall 14, and a bottom wall 15. The housing 11 is movably supported on front and rear support wheels 16F and 16R rotatably mounted near each corner of the housing.

The lower portion of an elongate rod-like handle 17 extends through a slot 18 in the top wall 14 of the housing 11 and is pivotally connected on the housing by a pivot pin 19, such that when the housing 11 is pushed forwardly away from the user, the upper end of the handle pivots rearwardly and downward and its lower end pivots forwardly and upward as shown in FIG. 1. When the housing 11 is pulled rearwardly toward the user, the upper end of the handle 17 pivots forwardly and upward and its lower end pivots rearwardly and downward, as shown in Fig. 7.

The bottom end of the handle 17 is pivotally connected to a linkage assembly 20 slidably mounted in the housing by conventional means, such as transverse support crossmembers 21 shown in dashed line. The linkage assembly 20 has a horizontal link member 22 connected through a slot 23 in the lower end of the handle 17 to move in a forward and rearward direction relative to the housing 11 and has a pair of laterally spaced depending front link members 24 and rear link members 25 at opposite ends.

A circular drive wheel 26 is rotatably mounted on each front link member 24 at the forward end of the horizontal link member 24 and each has a drive axle 27 which rotates therewith. The outer diameter of each drive wheel 26 is sufficient to engage the outer circumference of the front wheels 16F when the lower end of the handle 17 pushes the horizontal link 22 and front links 24 forward (FIG. 1) and to become disengaged therefrom when the lower end of the handle pushes the horizontal link and front links rearwardly (FIG. 7).

A cylindrical roller 28 having a central axle or drum 29 is rotatably mounted in bearings 30 at opposite sides of the housing 11 and extends transversely from side to side in the housing. A plurality of disk-shaped circular rings 31 formed of water absorbent resilient flexible foam rubber or elastomeric material are mounted on the roller drum 29 in adjacent parallel relation along its length. The outer diameter of the rings 31 is sufficient such that their outer circumference extends below the bottom wall 15 of the housing through an opening and engages the floor surface F to be cleaned. A continuous loop drive belt 32 formed of resilient material extends around the axles 27 of the drive wheels 26 and the roller drum 29.

Although two laterally opposed drive wheels 26 and belts 32 are shown in the illustrated example, it should be understood that only one drive wheel and belt arrangement may be used which wherein the roller 28 would be driven by a single belt 32 and single drive wheel 26 engaged on a single front wheel 16F.

Alternatively, as shown in dashed line in FIG. 2, the roller 28 may be driven by an electric motor M mounted on a front link member 24 at the forward end of the horizontal link member 22 and the drive axle 27 would be secured to the drive shaft of the motor. Tension would be applied to the belt 32 when the horizontal link 22 and front link 24 move forward and the tension would be released when the horizontal link and front link move rearward.

Figure 4:
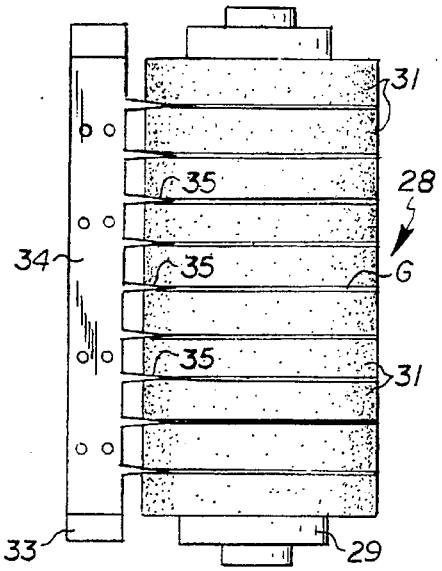
FIG. 4 is a bottom plan view of the separator plate taken along line 4—4 of FIG. 1 showing the separator fingers received between adjacent roller rings.
Figure 3:
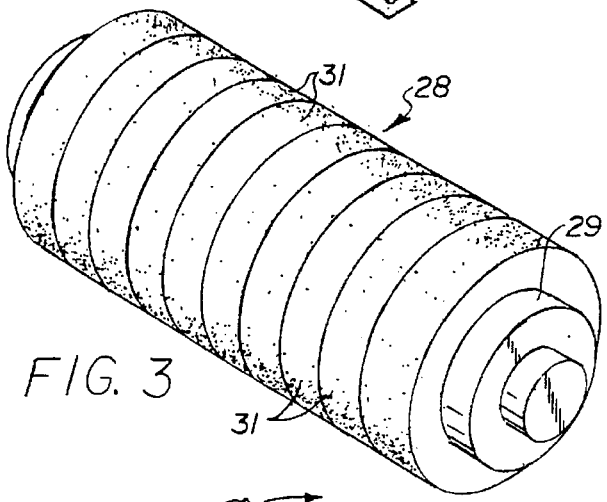
FIG. 3 is a perspective view of the roller member of the roller mop apparatus.
Figure 5:
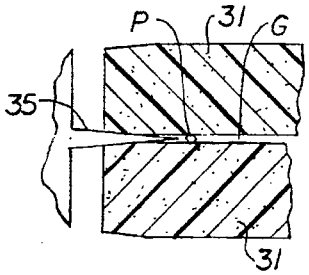
FIG. 5 is an enlarged detail of a separator finger removing particles of debris from adjacent roller rings.

As seen in FIGS. 1, 2, 4, and 7, a rectangular block 33 extends transversely across the bottom wall 15 of the housing 11. A flat rectangular separator plate 34 is secured to the block 33 and has a plurality of adjacent tapered finger elements 35 which are spaced apart along one longitudinal side of the separator plate and extend outwardly therefrom toward the roller 28. The separator fingers 35 are spaced apart and are of sufficient length such that their tapered outer ends are received between the flat surfaces of adjacent ones of the roller rings 31 (FIGS. 4 and 5). The separator plate 34 and fingers 35 are positioned a short distance above the floor surface to be cleaned and extend into the gap G between the roller rings 31 and spread the outer portion of the rings apart as the roller rings rotate relative to the fingers. In other words, the fingers 35 temporarily widen the gap between the adjacent roller rings as they pass across the fingers.

Referring again to FIGS. 1, 2, and 7, a used liquid and debris collection tank 36 is slidably mounted in the housing and connected to the rear links 25 depending from the rear end of the horizontal link member 22, such that when the horizontal link member is pushed forward, the collection tank 36 will also move forward toward the roller 28. The collection tank 36 has a bottom wall 37, opposed side walls 38, front and rear walls 39F and 39R, and an open top end. The front end wall 39F of the collection tank 36 extends angularly upward and outward from the bottom wall 37.

Figure 6:
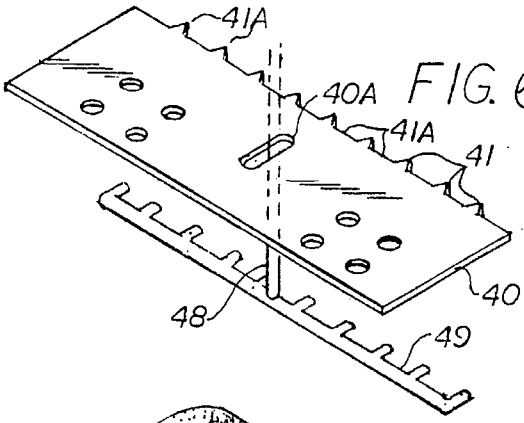
FIG. 6 is a perspective view of the squeegee plate showing a portion of the cleaning liquid conduit extending below the plate with nozzles for directing the liquid onto the roller.

Referring additionally to FIG. 6, a flat rectangular squeegee plate 40 is secured to the angular front wall 39F of the collection tank 36 and has a plurality of adjacent tapered tooth elements 41 spaced apart along the outward and upwardly facing longitudinal side of the squeegee plate which extend a short distance outwardly therefrom toward the roller 28. The tooth elements 41 are spaced apart to define flat surfaces 41A therebetween and are received between the flat surfaces of adjacent ones of the roller rings 31. When the collection tank 36 is moved forward by the horizontal link 22 and rear links 25, the outward and upwardly facing longitudinal side of the squeegee plate 40 is pressed against the upper portion of the outer circumference of the roller rings 31 in a tangential relation with the apex of the tooth elements 41 received between the flat surfaces of adjacent ones of the roller rings 31. When the collection tank moves rearward, the squeegee plate 40 is disengaged from the roller rings 31, as seen in FIG. 7.

Referring again to FIGS. 1, 2, and 7, a generally rectangular stop member 42 extends transversely across the bottom wall 15 of the housing 11 and has an angled surface 43 facing the angular front end wall 39F of the collection tank 36. The stop member 42 is adjustably mounted on the housing 11 by bolts 44 which extend through slots 45 in the side walls 13 of the housing and are threadedly engaged in the ends of the stop member 42. The travel distance of the collection tank 36 is manually adjusted by loosening the bolts 44 and positioning the stop member 42 relative to the roller. This adjustment also controls the amount of force with which the squeegee plate 40 engages the circumference of the roller rings 31.

A cleaning liquid reservoir 46 is mounted in the top wall 14 of the housing 11 and has a manually adjustable flow control valve 47 connected at the bottom thereof. The upper end of a tubular conduit 48 is connected to the flow control valve 47 and extends through an aperture 40A in the squeegee plate 40 and its bottom end is connected with a manifold of parallel spaced nozzles 49. The nozzles 49 are positioned to direct cleaning fluid from the reservoir 46 onto the roller rings 31 below the squeegee plate 40. The adjustable flow control valve 47 adjusts the amount of cleaning liquid which flows from the reservoir through the conduit 48.

A sliding shut-off valve 50 is installed in the conduit 48 between the flow control valve 47 and the nozzles 49 and is connected by a link 51 to the horizontal link member 22 such that when the horizontal link member is pushed forward, the valve 50 opens to allow cleaning liquid to flow through the conduit 48 to the nozzles 49 and onto the roller rings 31. When the horizontal link member 22 is pushed rearward, the valve 50 closes to prevent cleaning liquid from flowing through the nozzles 49 onto the roller rings 31.

OPERATION

As indicated by the arrows in FIG. 1, when the housing 11 is pushed forward by the handle 17, the lower end of the handle pivots forward and moves the horizontal link 22 and front links 24 forward to engage the outer diameter of the drive wheel 26 on the outer circumference of the front wheels 16F which are rotating in a clockwise direction and the drive wheels are rotated in a counterclockwise direction. As the drive wheels 26 move forward, tension is applied to the drive belts 32 by the axles 27 of the drive wheels, and as the belts turn rotary motion is transferred to the roller drum 29 and the roller rings 31 which are engaged on the floor surface to be cleaned, rotating the drum and rings in a counter-clockwise direction. The cleaning roller 28 thus rotates in the direction opposite to which the support wheels rotate and opposite the direction the mop is being pushed across the floor surface.

Also when the horizontal link 22 moves forward, it opens the shut-off valve 50 and cleaning liquid flows through the nozzles 49 onto the roller rings 31. At the same time, the forward movement of the horizontal link 22 and rear links 25 cause the collection tank 36 to move forward and the outward and upwardly facing longitudinal edge of the squeegee plate 40 is pressed against the outer circumference of the roller rings 31 in a tangential relation. In this position the apex of the tooth elements 41 are received between the flat surfaces of adjacent ones of the roller rings 31, and the flat surfaces 41A between the tooth elements are pressed against the exterior of the rings.

As the roller 28 rotates in the counterclockwise direction and passes the squeegee plate 40 the resilient foam rubber or elastomeric roller rings 31 receive clean cleaning fluid flowing from the nozzles 49 and become wet. As the wet rotating roller rings 31 pass the fingers 35 of the separator plate 34 the fingers widen the gap G between the adjacent roller rings as the lower portion of the roller rings engage the surface to be cleaned. As the roller rings 31 pass by the fingers 35, the gaps close as the rings engage the surface F to be cleaned and particles of debris P on the surface become pinched or trapped between the adjacent flat surfaces of the rings (FIG. 5).

As the roller rings continue to rotate they scrub the floor in the direction opposite that in which the mop is being pushed and the trapped particles of debris and dirty cleaning liquid is carried around the circumferential upward path in the rings. As the rotating rings enter their downward circumferential path they engage the longitudinal edge of the squeegee plate 40 which is pressed against the outer circumference of the roller rings 31. The resilient rings 31 are slightly compressed by the flat surfaces 41A of the squeegee plate and excess dirty cleaning liquid is wiped off or squeezed out along with small particles of debris carried by the rings which then runs down the squeegee plate into the collection tank 36. As the roller 28 rotates past the squeegee plate 40 and the dirty liquid and particles of debris are removed, the foam rubber or elastomeric roller rings 31 again receive clean cleaning fluid flowing from the nozzles 49 and become wet. This process is continues as long as the mop is traveling in a forward direction.

As indicated by the arrows in FIG. 7, when the housing 11 is pulled rearwardly by the handle 17, the lower end of the handle pivots rearward, moves the horizontal link 22 and front links 24 rearward to disengage the outer diameter of the drive wheels 26 from the outer circumference of the front wheels 16F which are rotating in a counter-clockwise direction. When the drive wheels 26 are disengaged and their axles 27 move away from the front wheel, the tension in the drive belt is released, and the roller rings 31 which are engaged on the surface being cleaned rotate freely along the surface in a counter-clockwise direction (in the same direction the support wheels rotate).

Also when the horizontal link 22 moves rearward, it closes the shut-off valve 50 and prevents cleaning liquid from flowing through the nozzles 49 onto the roller rings 31. At the same time, the rearward movement of the horizontal link 22 and rear links 25 cause the collection tank 36 to move rearward and the outward and upwardly facing longitudinal edge of the squeegee plate 40 is disengaged from the outer circumference of the roller rings 31. Thus, the rings 31 are not wetted on the pulling stroke and are not engaged by the squeegee plate 40.

However, as the mop is pulled rearwardly and the roller rings 31 rotating in the counterclockwise direction pass the fingers 35 of the separator plate 34 the fingers widen the gap G between the adjacent roller rings 31 as the lower portion of the roller rings roll on the surface being cleaned. As the roller rings 31 pass by the fingers 35, the gaps close as the rings engage and roll on the surface being cleaned and particles of debris on the surface become pinched or trapped between the adjacent flat surfaces of the rings. As the rings 31 continue to roll on the surface, the trapped particles of debris are carried around the circumferential path of the rings. Thus particles of debris are picked up by the roller rings whether the mop is being pushed forward or being pulled rearward.

When the mop is again pushed forward, the handle 17 moves the horizontal link 22 forward, and engages the drive wheels 26 on the front wheels 16F and tension is again applied to the drive belt 32 to engage and drive the drum 29 and roller rings 31 in a counter-clockwise direction. The shut-off valve 50 is opened, cleaning liquid flows through the nozzles 49 onto the roller rings 31, the collection tank 36 is moved forward and the squeegee plate 40 is pressed against the outer circumference of the roller rings 31, and the process is repeated.

It should be understood that only one drive wheel and belt arrangement may be used wherein the roller would be driven by a single belt and single drive wheel engaged on a single front wheel.

Alternatively, the roller 28 may be driven by an electric motor M mounted on a front link member 24 at the forward end of the horizontal link member 22 with the drive axle 27 secured to the drive shaft of the motor. The operation would be the same as described above, except that tension would be applied to the belt 32 when the horizontal link 22 and front link 24 move forward and the tension would be released when the horizontal link and front link move rearward.

While this invention has been described fully and completely with special emphasis upon a preferred embodiment, it should be understood that within the scope of the appended claims the invention may be practiced otherwise than as specifically described herein.

I claim:

1. A roller mop apparatus for cleaning floors and removing particles of debris therefrom comprising:

a support structure including a housing having a front wall, a rear wall, opposed side walls and a bottom end;

support wheel means rotatably mounted on said support structure for supporting and moving said structure in a forward and rearward direction on a floor surface to be cleaned;

handle means pivotally connected with said support structure for moving said structure relative to said floor surface, said handle means connected to pivot relative to said support structure and having an upper end extending outwardly from said support structure and a lower end disposed within said support structure;

a generally cylindrical cleaning roller rotatably mounted on said support structure on a transverse axis and having an outer circumference formed of water flexible water absorbing material of sufficient diameter to engage said floor surface;

linkage means connected with said handle means lower end to move in a forward or rearward direction relative to said support structure when said handle means is pivoted;

rotary drive transfer means connected with said linkage means to engage said support wheel means when said linkage means is moved in a forward direction and to become disengaged therefrom when said linkage means is moved in a rearward direction;

said rotary drive transfer means releasably connected with said cleaning roller to transfer rotary motion from said support wheel means to said roller when engaged with said support wheel means, and to become disconnected from said roller when disengaged from said support wheel means.

2. A roller mop apparatus according to claim 1 wherein said rotary drive transfer means comprises a drive wheel connected with said linkage means to engage said support wheel means when said linkage means is moved in a forward direction and to become disengaged therefrom when said linkage means is moved in a rearward direction, said drive wheel having an axle affixed thereto to rotate therewith;

a belt forming a loop around said drive wheel axle and said cleaning roller;

said drive wheel axle applying tension in said belt when said linkage means is moved in a forward direction and transferring rotary motion through said belt to said cleaning roller when engaged on said support wheel means; and said drive wheel axle releasing tension in said belt when said linkage means is moved in a rearward direction and said drive wheel is disengaged from said support wheel means to allow said cleaning roller to rotate independently from said support wheel means.

3. A roller mop apparatus according to claim 1 wherein said rotary drive transfer means comprises an electric motor connected with a source of electrical power and having a drive axle mounted on its rotary output shaft;

a belt forming a loop around said motor drive axle and said cleaning roller;

said motor drive axle applying tension in said belt when said linkage means is moved in a forward direction and transferring rotary motion through said belt to said cleaning roller; and said motor drive axle releasing tension in said belt when said linkage means is moved in a rearward direction to allow said cleaning roller to rotate independently from said motor.

4. A roller mop apparatus according to claim 1 wherein said cleaning roller has a central generally cylindrical axle rotatably mounted on said support structure on a transverse axis; and a plurality of circular disk-shaped rings formed of resilient flexible water absorbing material mounted on said axle in adjacent parallel relation along its length and defining said outer circumference of sufficient diameter to engage said floor surface.

5. A roller mop apparatus according to claim 4 further comprising separator means extending transversely across said support structure bottom end adjacent to said cleaning roller outer circumference and having a plurality of adjacent spaced apart projections along a longitudinal side thereof extending outwardly therefrom and received between adjacent ones of said disk-shaped rings; and said projections being positioned and shaped to form a gap between adjacent ones of said disk-shaped rings as they rotate relative to said projections and engage said floor surface; whereby said gaps close as said rings engage and roll on said floor surface to capture particles of debris on said floor surface between adjacent ones of said disk-shaped rings and lift them from said surface.

6. A roller mop apparatus according to claim 1 further comprising a cleaning liquid reservoir mounted on said support structure for containing a supply of cleaning liquid;

conduit means connected at one end to said cleaning liquid reservoir for conducting cleaning fluid therethrough and having another end adapted to direct cleaning fluid flowing therethrough onto said cleaning roller;

shut-off valve means connected in fluid communication with said conduit means and connected with said linkage means to allow cleaning fluid to flow through said conduit means when said linkage means is moved in a forward direction and to prevent said cleaning fluid from flowing therethrough when said linkage means is moved in a rearward direction.

7. A roller mop apparatus according to claim 6 further comprising manually adjustable flow control valve means connected in fluid communication with said conduit means to manually adjust the amount of said cleaning liquid flowing from said reservoir through said conduit means.

8. A roller mop apparatus according to claim 6 further comprising a dirty-liquid and debris container extending transversely across said support structure adjacent to said cleaning roller outer circumference; and a squeegee element extending transversely across said support structure and between said dirty-liquid and debris container and said cleaning roller outer circumference;

said squeegee element having one longitudinal side extending outwardly therefrom to engage said cleaning roller outer circumference and remove excess dirty liquid and particles of debris from said cleaning roller as said cleaning roller rotates relative thereto and direct said removed dirty liquid and particles of debris into said container.

9. A roller mop apparatus according to claim 8 wherein said dirty-liquid and debris container and said squeegee element are connected with said linkage means to engage and press said squeegee element longitudinal side against said cleaning roller outer circumference when said linkage means is moved in a forward direction and to become disengaged therefrom when said linkage means is moved in a rearward direction.

10. A roller mop apparatus according to claim 9 wherein said cleaning roller has a central generally cylindrical axle rotatably mounted on said support structure on a transverse axis; and a plurality of circular disk-shaped rings formed of resilient flexible water absorbing material mounted on said axle in adjacent parallel relation along its length and defining said outer circumference of sufficient diameter to engage said floor surface.

11. A roller mop apparatus according to claim 10 wherein said squeegee element extends across a longitudinal side of said dirty-liquid and debris container;

said squeegee element longitudinal side has a plurality of adjacent spaced apart tapered projections defining flat surfaces between adjacent tapered projections; and said flat surfaces are engaged and pressed against the outer circumference of said disk-shaped rings and the outer ends of said tapered projections are received between adjacent ones of said disk-shaped rings when said squeegee element is engaged and pressed against said outer circumference of said disk-shaped rings.

* * * * *